US012357903B2

(12) United States Patent
Tameen

(10) Patent No.: US 12,357,903 B2
(45) Date of Patent: Jul. 15, 2025

(54) SKATEBOARD WITH STEERING CONTROL ASSEMBLY

(71) Applicant: Ptahchi Tameen, Atlanta, GA (US)

(72) Inventor: Ptahchi Tameen, Atlanta, GA (US)

( * ) Notice: Subject to any disclaimer, the term of this patent is extended or adjusted under 35 U.S.C. 154(b) by 64 days.

(21) Appl. No.: 18/301,065

(22) Filed: Apr. 14, 2023

(65) Prior Publication Data

US 2023/0330511 A1 Oct. 19, 2023

Related U.S. Application Data

(60) Provisional application No. 63/372,950, filed on Apr. 19, 2022.

(51) Int. Cl.
*A63C 17/01* (2006.01)

(52) U.S. Cl.
CPC ..... *A63C 17/011* (2013.01); *A63C 17/015* (2013.01); *A63C 2203/42* (2013.01)

(58) Field of Classification Search
CPC ..... A63C 17/011
See application file for complete search history.

(56) References Cited

U.S. PATENT DOCUMENTS 4,076,267 A * 2/1978 Lipscomb ..... A63C 17/18 280/400
4,082,306 A * 4/1978 Sheldon ..... A63C 17/01 D21/765
5,540,455 A * 7/1996 Chambers ..... A63C 5/035 280/87.041
12,053,690 B2 * 8/2024 Kermani ..... A63C 17/016
2009/0166993 A1 * 7/2009 Jackman ..... A63C 17/01 280/87.042
2010/0171298 A1 * 7/2010 Chen ..... B62K 3/002 280/786
2010/0219597 A1 * 9/2010 Choi ..... A63C 17/0033 280/87.042
2010/0225080 A1 * 9/2010 Smith ..... A63C 17/0033 280/87.042
2017/0095725 A1 * 4/2017 Sala ..... A63C 17/015

* cited by examiner

*Primary Examiner* — Brian L Swenson
(74) *Attorney, Agent, or Firm* — Taylor Duma LLP

(57) ABSTRACT

A skateboard comprising a board including a front portion and a rear portion, the front and rear portions being disposed in a horizontal plane such that a uniform gap is formed there between; a front wheel assembly including a pair of wheels, the front wheel assembly being secured to a bottom surface of the front portion of the board; a rear wheel assembly including a pair of wheels, the rear wheel assembly being secured to a bottom surface of the rear portion of the board; and a steering control assembly secured to both the front portion and the rear portion of the board, wherein the steering control assembly is configured to allow pivotable movement of the front portion and the rear portion of the board about both a longitudinal center axis of the skateboard that lies in a horizontal plane and a vertical pivot axis that is transverse to the longitudinal center axis of the skateboard.

14 Claims, 4 Drawing Sheets

SKATEBOARD WITH STEERING CONTROL ASSEMBLY

This application claims priority to U.S. Provisional Application No. 63/372,950, filed Apr. 19, 2022, the entire disclosure of which is incorporated by reference herein.

TECHNICAL FIELD OF THE INVENTION

The technical field of this invention relates in general to wheeled recreational motive devices and, more particularly, to skateboards with assemblies for enhanced steering control by a user.

BACKGROUND OF THE INVENTION

Conventional skateboards are steered by the rider leaning to one side or the other to tilt the board, the wheels being pivoted on an inclined axis to provide a turning action when the board is tilted. This action is fairly easy for older, typically heavier riders. However, younger and/or lighter riders tend to have to use more body lean to achieve the same rate and amount of turn as do the heavier riders. As well, all riders may desire to effect turns more rapidly than is possible on standard skateboard designs. As such, skateboards with a dual board design have been developed that may increase the rate and/or amount of turn. Although these designs may allow each board portion to rotate independently about a longitudinal center axis of the board, the portions are not pivotal with respect to the longitudinal center axis in the horizontal plane.

The present invention recognizes and addresses the above, as well as other, considerations of prior art as to constructions and methods.

SUMMARY OF THE INVENTION

The skateboard described herein is divided transversely into front and rear sections which are joined by a control assembly that allows for rotation about a longitudinal center axis of the skateboard, as well as pivoting of the front and rear portions of the board with respect to a vertical pivot axis that is transverse to the longitudinal center axis. The two ends of the skateboard can thus be laterally tilted independently by the rider's feet to obtain steering action.

The longitudinal center axis about which the portions of the skateboard rotate may be spaced below the board or be substantially in the plane of the board, and the division between the board portions may be at the center or closer to one end of the board. The vertical pivot axis about which the board portions pivot preferably intersects the center portion of the control assembly that is disposed between the two board portions. In its basic form the skateboard uses conventional wheeled trucks with resilient, inclined axis wheel mountings.

The primary objective of this invention, therefore, is to provide a new and improved articulated skateboard that facilitates turning.

Another object of this invention is to provide an articulated skateboard divided into two sections coupled by a pivotal control assembly connecting the two board portions.

A further object of this invention is to provide an articulated skateboard adaptable to a variety of wheel and skate type supports.

The accompanying drawings, which are incorporated in and constitute a part of this specification, illustrate one or more embodiments of the invention and, together with the description, serve to explain the principles of the invention.

BRIEF DESCRIPTION OF DRAWINGS

A full and enabling disclosure of the present invention, including the best mode thereof, directed to one of ordinary skill in the art, is set forth in the specification, which makes reference to the appended drawings, in which.

Figure 1A:
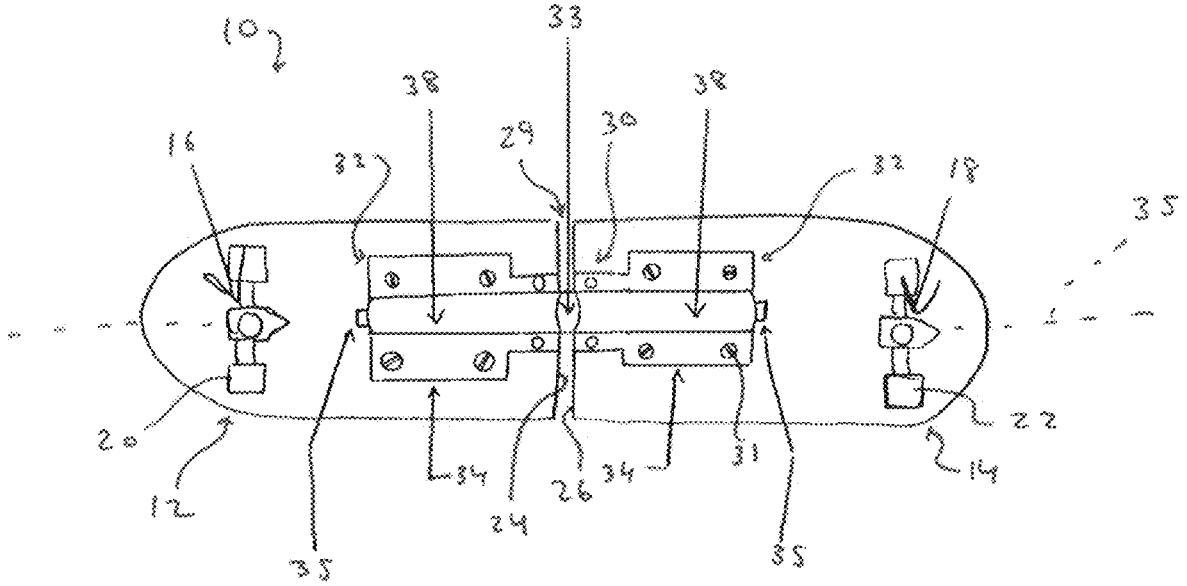
FIGS. 1A, 1B and 1C are a bottom plan, a top plan, and a side plan view, respectively, of a skateboard including a steering control assembly in accordance with an embodiment of the present disclosure.

Repeat use of reference characters in the present specification and drawings is intended to represent same or analogous features or elements of the invention according to the disclosure.

DETAILED DESCRIPTION OF PREFERRED EMBODIMENTS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a loop" can refer to one or more of such loops, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedents "about," "substantially," or "generally," it is contemplated that values within up to 15%, up to 10%, up to 5%, or up to 1% (above or below) of the particularly stated value can be included within the scope of those aspects. In other aspects, when angular values are approximated by use of the antecedents "about," "substantially," or "generally," it is contemplated that angular values within up to 15 degrees, up to 10 degrees, up to 5 degrees, or up to one degree (above or below) of the particularly stated angular value can be included within the scope of those aspects.

The word "or" as used herein means any one member of a particular list and, unless context dictates otherwise, can also include any combination of members of that list.

In the following description and claims, wherever the word "comprise" or "include" is used, it is understood that the words "comprise" and "include" can optionally be replaced with the words "consists essentially of" or "consists of" to form another embodiment.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

As further explained below, various conditions would benefit from real-time monitoring of disease progression. In particular, synthetic vascular grafts, vessel transplants, and systemic diseases would benefit from real-time monitoring.

Figure 1B:
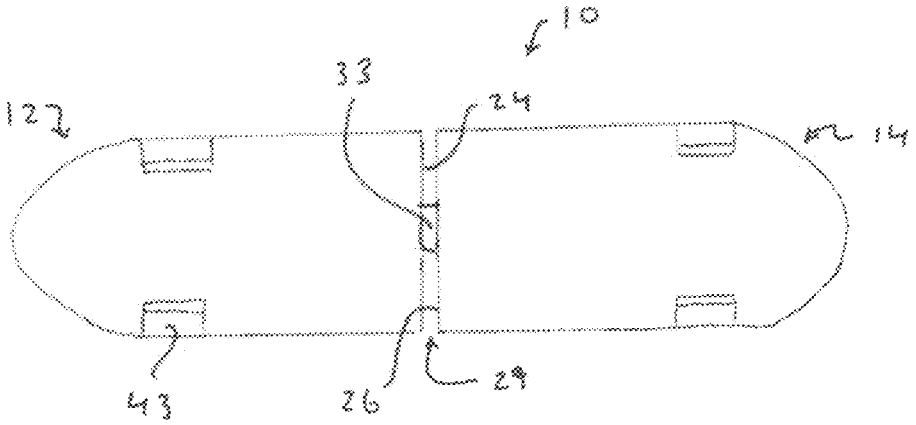
Figure 1C:
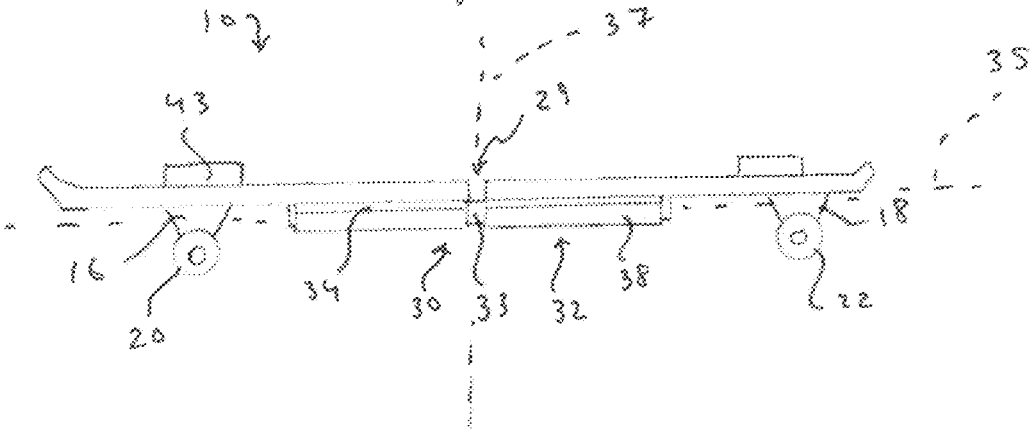
Figure 2:
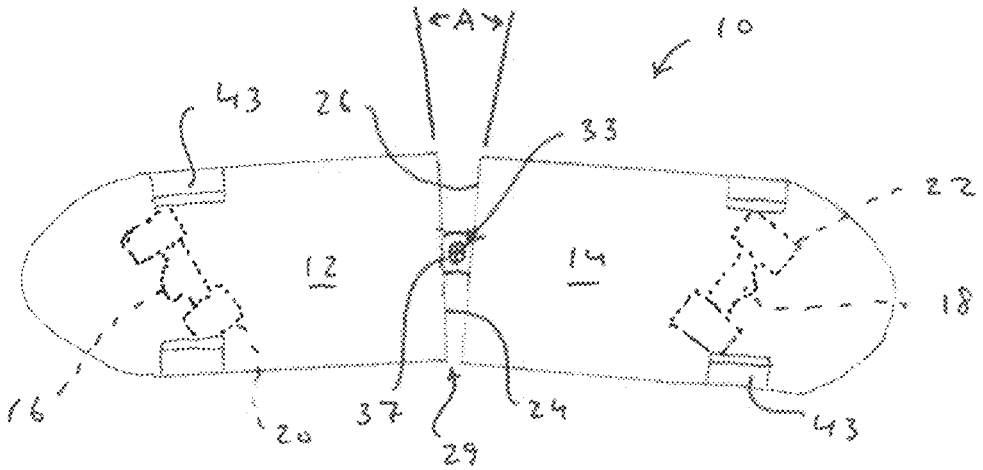
FIG. 2 is a top plan view of the skateboard shown in FIG. 1 during a left-hand turn.

Referring now to FIGS. 1A through 1C, a skateboard 10 including an embodiment of a control assembly 70 in accordance with the present invention includes a front portion 12 and a rear portion 14, forming an elongated substantially planar board. The planform or outline can be of any suitable configuration. Since many skateboards can be ridden in either direction, it should be understood that the terms front and rear are for descriptive purposes only. The opposite ends of the board are supported on conventional skateboard trucks 16 and 18, with resiliently mounted, self-centering wheels 20 and 22, respectively. The wheel support of each truck is pivotal about an axis inclined to the plane of the board to provide the well-known steering action when the board is tilted. Many different truck designs are available and most are suitable for the articulated board.

The separation of the front and rear sections is shown as being at the center of the length of the board, but could be offset toward either end to suit particular riding conditions. At the junction, front portion 12 has an end wall 24, and rear portion 14 has a similar end wall 26. The end walls 24 and 26 are substantially parallel and define a uniform gap 29 there between. Preferably, the two board portions 12 and 14 pivot readily under foot pressure, but are not too freely movable without intentional control. As shown, foot steps 43 may also be provided on the top of the front and rear portions 12 and 14 to facilitate turning.

As shown, the control assembly 30 for the skateboard 10 includes a pair of brackets 32 securing a pivot spring 33 to the front and rear board portions 12 and 14. Each bracket includes a flange 34 and an elongate protrusion 38 that defines a through bore therein. Each bracket 32 is mounted to the underside surface of a corresponding board portion 12 and 14 adjacent the corresponding end wall 24 and 26. In the embodiment shown, threaded fasteners 31 secure the flanges 34 of the brackets 32 to the corresponding board portions 12 and 14. The bores defined by the elongated portions 38 of the brackets 32 are both configured to receive an end portion of the pivot spring 33 therein so that the pivot spring 33 is supported between the board portions 12 and 14 and maintains the uniform gap 29 therebetween. Preferably, spring tensioners 35, in the form of threaded plugs, are received in correspondingly threaded end portions of the bores adjacent the opposite ends of the pivot spring 33. Rotation of one or both of the spring tensioners 35 allows a user to either increase inward force on the pivot spring 33, compression, or decrease inward force on the spring, extension, thereby allowing the ability to tilt the board portions 12 and 14 with respect to each other to be altered.

Figure 3:
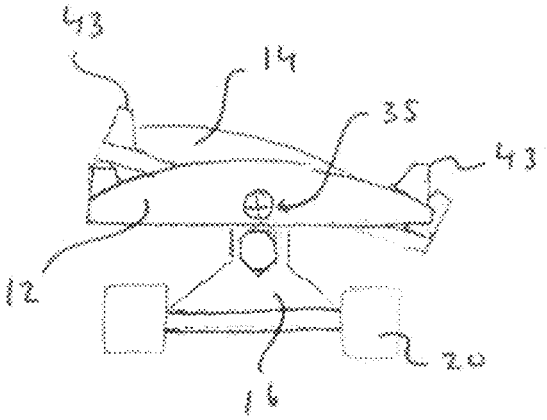
FIG. 3 is a front plan view of the skateboard shown in FIG. 1 with the rear portion of the skateboard rotating with respect to both the longitudinal center axis of the skateboard and the front board portion.

Referring now to FIG. 3, the front and rear board portions 12 and 14 may be rotated about a longitudinal center axis 35 of the skateboard 10 independently of each other. For example, if a rider keeps his front foot stationary on the front portion 12 but tilts his rear foot on the rear portion 14, only the rear portion 14 of the skateboard 10 rotates about longitudinal center axis 35. In this manner, the rider can effect a rather gradual left-hand turn, as shown in FIG. 3. However, if the rider wants to turn more rapidly, the rider can push downwardly on the left-hand side of both the front and rear portions 12 and 14 of the board so that both sets of wheels 20 and 22 contribute to the turn, as shown in FIG. 3. Note also, the pivot spring 33 of the control assembly 30 allows both front and rear portions 12 and 14 to pivot in the horizontal plane with respect to each other about a vertical pivot axis 37 that is transverse to the longitudinal center axis 35. In this condition, the end walls 24 and 26 of the front and rear portions 12 and 14 no longer form a unitary gap. Rather, the end walls 24 and 26 define an angle (A) therebetween, with the gap being wider on the side of the skateboard 10 that is opposite the direction of turn.

Figure 4A:
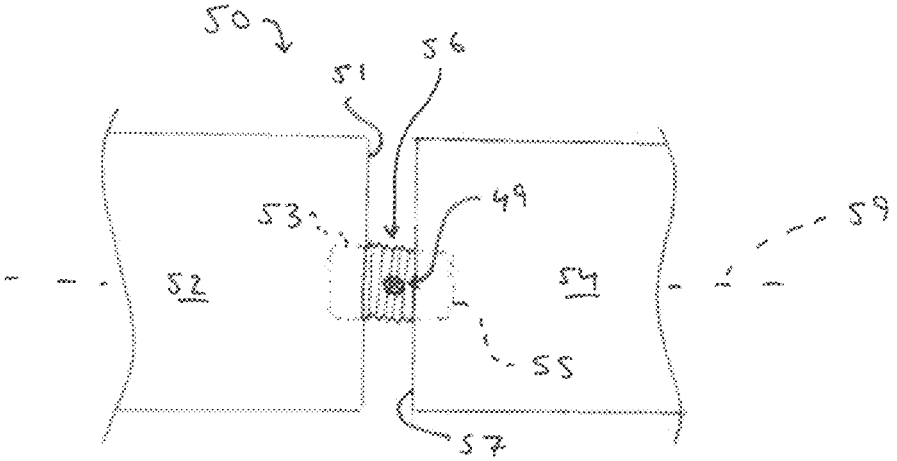
FIGS. 4A and 4B are partial top and side views, respectively, of an alternate embodiment of a skateboard including a control assembly in accordance with the present disclosure.
Figure 4B:
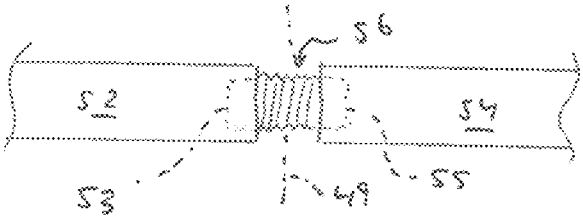
Figure 5A:
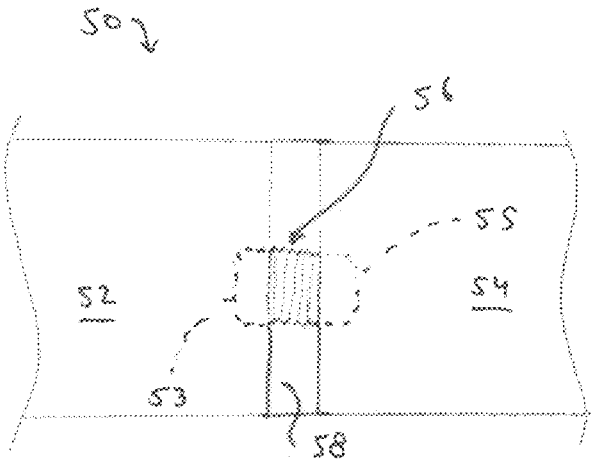
FIGS. 5A and 5B are partial top and side views, respectively, of an alternate embodiment of a skateboard including a steering control assembly in accordance with the present disclosure.
Figure 5B:
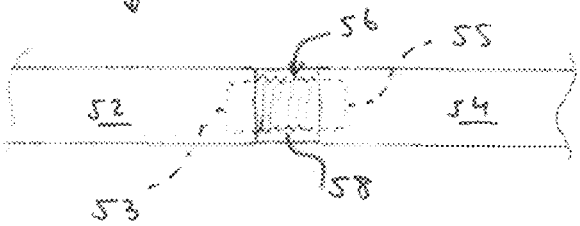
Figure 6A:
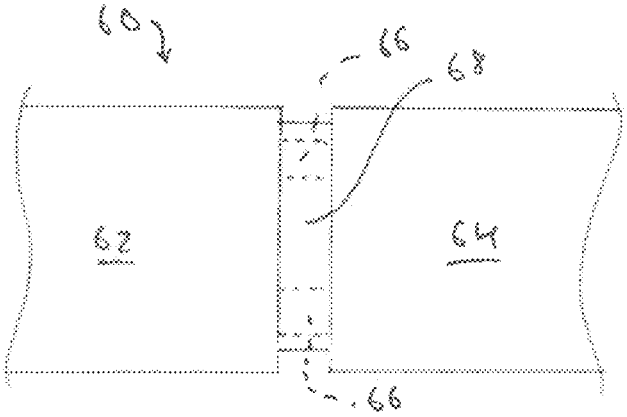
FIGS. 6A and 6B are partial and top views, respectively, of an alternate embodiment of a skateboard including a control assembly in accordance with the present disclosure.
Figure 6B:
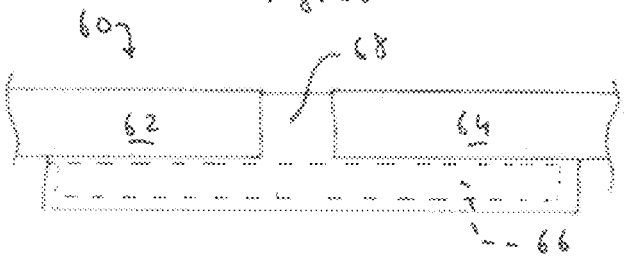

In the configuration illustrated in FIGS. 4A and 4B the skateboard 50 has front and rear board portions 52 and 54 joined by a pivot spring 56 contained in the thickness of the board. As shown, each end of the pivot spring 56 is secured in a corresponding blind bore 53 and 55 formed in the end walls 51 and 57 of the front and rear board portions 52 and 54, respectively. As with the first embodiment shown in FIGS. 1A through 1C, the pivot spring 56 allows rotation of the front and rear board portions 52 and 54 about the longitudinal center axis 59 of the skateboard 50, as well as a vertical pivot axis 49 that is transverse to the longitudinal center axis 59. As shown in FIGS. 5A and 5B the front and rear board portions 52 and 54 may also be joined by an elastomeric connector 58 that is securely bonded to the opposing end walls 51 and 57 of the board portions 52 and 54, the elastomeric material enclosing the pivot spring 56. This provides a resilient self-centering connection which will accommodate the necessary differential tilting action of the sections.

In the configuration shown in FIGS. 5A and 5B, the skateboard 60 has front and rear portions 62 and 64 joined by a pair of pivot springs 66. Unlike the embodiments shown in FIGS. 4A, 4B and 5A, 5B, the pivot springs 66 of skateboard 60 are attached to the bottom surface of the skateboard 60 by an elastomeric connector 68 that is securely bonded to the bottom surfaces of the front and rear portions 62 and 64. Note, the elastomeric connector 68 may or may not fill the gap 67 between the inner end walls of the front and rear portions 62 and 64.

Figure 7A:
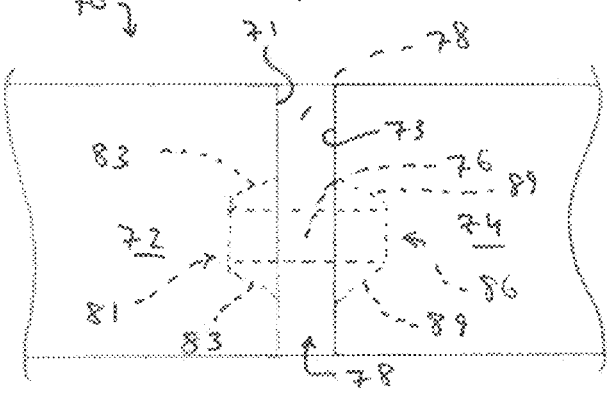
FIGS. 7A and 7B are partial and top views, respectively, of an alternate embodiment of a skateboard including a control assembly in accordance with the present disclosure.
Figure 7B:
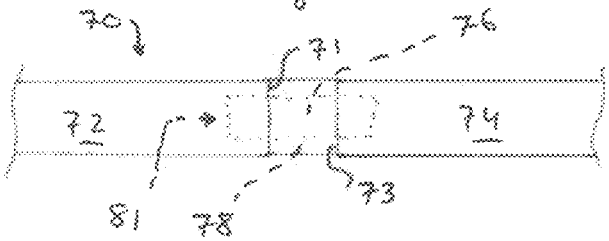

Referring now to FIGS. 7A and 7B, an alternate embodiment of a skateboard 70 includes front and rear portions 72 that are connected by an elastomeric connector 78 that fills the gap 77 formed by the end walls 71 and 73 of the front and rear portions 72 and 74. As well, disposed within the elastomeric connector 78, a rigid elongate member 76 extends from a recess 81 formed in the end wall 71 of the front portion 72 to a recess 86 formed in the end wall 73 of the rear portion 74. Note, the top and bottom walls of the recesses 81 and 86 are separated by a distance that is substantially the same as the diameter of the rigid elongate member 76. As such, the rigid elongate member 76 prevents the inner ends of the front and rear portions 72 and 74 from being urged downwardly by the weight of the user. However, the sets of side walls 83 and 84 of the recesses 81 and 86, respectively, diverge from each other as they extend from their corresponding base walls of each recess. As such, the rigid elongate member 76 is still free to have limited pivoting motion in the horizontal plane with respect to the front and rear portions.

Although the foregoing invention has been described in some detail by way of illustration and example for purposes of clarity of understanding, certain changes and modifications may be practiced within the scope of the appended claims.

The invention claimed is:

1. A skateboard comprising:

a board including a front portion and a rear portion, the front and rear portions being disposed in a horizontal plane such that a uniform gap is formed there between;

a front wheel assembly including a pair of wheels, the front wheel assembly being secured to a bottom surface of the front portion of the board;

a rear wheel assembly including a pair of wheels, the rear wheel assembly being secured to a bottom surface of the rear portion of the board; and a steering control assembly including a linear elongated resilient member secured to both the front portion and the rear portion of the board, wherein the steering control assembly is configured to allow pivotable movement of the front portion and the rear portion of the board about both a longitudinal center axis of the skateboard that lies in a horizontal plane and a vertical pivot axis that is transverse to the longitudinal center axis of the skateboard, and wherein a longitudinal center axis of the linear elongated resilient member is parallel to the longitudinal center axis of the skateboard.

2. The skateboard of claim 1, the steering control assembly further comprising:

a first bracket secured to the bottom surface of the front portion of the board adjacent the gap; and a second bracket secured to the bottom surface of the rear portion of the board adjacent the gap;

wherein a first end of the linear elongated resilient member is secured to the first bracket and a second end of the linear elongated resilient member is secured to the second bracket.

3. The skateboard of claim 2, wherein both the first and the second brackets define a bore, and the first end and the second end of the linear elongated resilient member are secured within the bores.

4. The skateboard of claim 3, wherein the linear elongated resilient member further comprises a spring.

5. The skateboard of claim 1, wherein the front portion of the board includes an end wall, defining a blind bore, the rear portion of the board includes an end wall defining a blind bore, and opposing ends of the linear elongated resilient member are secured in the blind bores of the front and the rear portions.

6. The skateboard of claim 5, wherein the linear elongated resilient member further comprises a spring.

7. The skateboard of claim 6, further comprising an elastomeric connector section that is disposed in a gap defined between the end walls of the front and rear portions of the board.

8. A skateboard comprising:

a board including a front portion and a rear portion, the front and rear portions being disposed in a horizontal plane such that a uniform gap is formed there between;

a front wheel assembly including at least one wheel, the front wheel assembly being secured to a bottom surface of the front portion of the board;

a rear wheel assembly including at least one wheel, the rear wheel assembly being secured to a bottom surface of the rear portion of the board; and a steering control assembly secured to both the front portion and the rear portion of the board, wherein the steering control assembly is configured to allow pivotable movement of the front portion and the rear portion of the board about a longitudinal center axis of the skateboard that lies in a horizontal plane, wherein the steering control assembly incudes an elongated member secured to both the front portion and the rear portion of the board, and the steering control assembly is also configured to address pivotable movement about a vertical pivot axis that is transverse to the longitudinal center axis of the skateboard, and wherein the front portion of the board includes an end wall defining a blind bore, the rear portion of the board includes an end wall defining a blind bore, and opposing ends of the elongated member are secured in the blind bores of the front and the rear portions.

9. The skateboard of claim 8, the steering control assembly further comprising:

a first bracket secured to the bottom surface of the front portion of the board adjacent the gap; and a second bracket secured to the bottom surface of the rear portion of the board adjacent the gap;

wherein a first end of the elongated member is secured to the first bracket and a second end of the elongated member is secured to the second bracket.

10. The skateboard of claim 9, wherein both the first and the second brackets define a bore, and the first end and the second end of the elongated member are secured within the bores.

11. The skateboard of claim 10, wherein the elongated member further comprises a spring.

12. The skateboard of claim 8, wherein the elongated member further comprises a spring.

13. The skateboard of claim 12, further comprising an elastomeric connector section that is disposed in the gap defined between the end walls of the front and rear portions of the board.

14. The skateboard of claim 8, the steering control assembly comprising:

a recess defined by an inner end wall of the front portion of the board;

a recess defined by an inner end wall of the rear portion of the board;

a rigid elongated member having opposing end portions disposed in the recesses of the front and rear portions; and an elastomeric connector section disposed between the end walls of the front and rear portions and in the recesses thereof.

* * * * *